US009478878B2

(12) United States Patent
Wu et al.

(10) Patent No.: US 9,478,878 B2
(45) Date of Patent: Oct. 25, 2016

(54) CABLE CONNECTOR ASSEMBLY WITH SIMPLE ARRANGEMENT OF CORE WIRES

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/819,729

(22) Filed: Aug. 6, 2015

(65) Prior Publication Data

US 2016/0043517 A1 Feb. 11, 2016

(30) Foreign Application Priority Data

Aug. 7, 2014 (CN) ..... 2014 1 0385995

(51) Int. Cl.

| | |
|---|---|
| ***H01R 24/00*** | (2011.01) |
| ***H01R 12/53*** | (2011.01) |
| ***H01R 9/05*** | (2006.01) |
| *H01R 13/66* | (2006.01) |

(52) U.S. Cl.

CPC ..... *H01R 12/53* (2013.01); *H01R 9/0515* (2013.01); *H01R 13/6658* (2013.01)

(58) Field of Classification Search

CPC ..... H01R 23/7068; H01R 23/7073; H01R 23/725; H01R 23/70; H01R 23/02; H01R 13/26; H01R 13/658

USPC ..... 439/660, 607.01–607.05, 629, 76.1

See application file for complete search history.

(56) References Cited

U.S. PATENT DOCUMENTS

| | | | | |
|---|---|---|---|---|
| 6,869,308 | B2 * | 3/2005 | Wu | H01R 12/62 439/497 |
| 7,134,914 | B1 * | 11/2006 | Wu | H01R 13/5804 439/357 |
| 7,147,502 | B1 * | 12/2006 | Wu | H01R 13/6275 439/352 |
| 7,364,465 | B2 * | 4/2008 | Wu | H01R 13/6275 439/607.41 |
| 7,534,141 | B1 * | 5/2009 | Wu | H01R 24/62 439/607.01 |
| 7,632,155 | B1 * | 12/2009 | Wu | H01R 9/035 439/497 |
| 7,651,379 | B1 * | 1/2010 | Wu | H01R 12/62 439/108 |
| 7,654,831 | B1 * | 2/2010 | Wu | H01R 12/62 439/607.46 |
| 7,909,632 | B2 * | 3/2011 | Wu | H01R 9/03 439/353 |
| 7,909,654 | B2 * | 3/2011 | He | H01R 13/6658 439/607.22 |
| 8,011,950 | B2 * | 9/2011 | McGrath | H01R 12/594 439/497 |

(Continued)

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

A cable connector assembly for mating with a mating connector in two directions includes a PCB, a cable, and a housing. The PCB includes a front end portion, a rear end portion, and a middle portion. The front end portion includes some front conductive pads, while the rear end portion includes some rear conductive pads. The PCB includes an upper surface and a lower surface. The cable includes some coaxial wires and single wires. All the coaxial wires are soldered on one surface, and all the single wires are soldered on another surface of the PCB. Part of the rear conductive pads soldered with the coaxial wires are electrically connected to the front conductive pads on the upper surface through a layer of conductive path, while the other rear conductive pads are electrically connected to the front conductive pads on the lower surface through another layer of conductive path.

13 Claims, 10 Drawing Sheets

(56) References Cited

U.S. PATENT DOCUMENTS 8,083,546 B2 * 12/2011 Lee ..... H01R 27/00 439/607.02
8,133,071 B2 3/2012 Huang et al.
8,152,568 B2 * 4/2012 Wu ..... H01R 13/6658 439/353
8,696,388 B2 * 4/2014 Gao ..... H01R 12/721 439/607.19
8,851,906 B2 * 10/2014 Wu ..... H01R 13/6581 439/607.45
9,203,193 B2 * 12/2015 Hackman ..... H01R 13/648
9,257,797 B2 * 2/2016 Kuang ..... H01R 9/038
2010/0015851 A1 * 1/2010 Wu ..... H01R 12/62 439/607.01
2014/0017943 A1 * 1/2014 Wu ..... H01R 13/6581 439/620.22
2014/0220822 A1 * 8/2014 Keyser ..... H01R 13/6595 439/607.46

* cited by examiner

CABLE CONNECTOR ASSEMBLY WITH SIMPLE ARRANGEMENT OF CORE WIRES

BACKGROUND OF THE INVENTION

1. Field of the Invention

The present invention relates to a cable connector assembly, and more particularly to an arrangement of core wires thereof.

2. Description of Related Art

U.S. Pat. No. 8,133,071, issued on Mar. 13, 2012, shows a cable connector assembly including a cable and a flexible printed circuit. The cable defines a row of core wires and an insulative layer enclosing the core wires. The core wires comprise a plurality of coaxial cables and a plurality of single wires. The flexible printed circuit comprises a plurality of pads arranged in a line and a lengthwise grounding portion separated from the pads. Each coaxial cable comprises an inner conductor connected to a corresponding pad and an outer conductor connected to the grounding portion. The single wires comprise a plurality of power wires connected to corresponding pads and a plurality of grounding wires connected to the grounding portion. However, the coaxial cables and the single wires are arranged in one row and need be handled separately, causing inconvenience to production process.

An improved cable connector assembly is desired to offer advantages over the related art.

BRIEF SUMMARY OF THE INVENTION

An object of the present invention is to provide a cable connector assembly with simple arrangement of core wires to improve production efficiency.

To achieve the above-mentioned object, a cable connector assembly for mating with a mating connector in two directions includes a PCB, a cable, and a housing. The PCB includes a front end portion, a rear end portion, and a middle portion. The front end portion includes some front conductive pads, while the rear end portion includes some rear conductive pads. The PCB includes an upper surface and a lower surface. The cable includes some coaxial wires and single wires. All the coaxial wires are soldered on one surface, and all the single wires are soldered on another surface of the PCB. Part of the rear conductive pads soldered with the coaxial wires are electrically connected to the corresponding front conductive pads on the upper surface through a layer of conductive path, while the other rear conductive pads are electrically connected to the corresponding front conductive pads on the lower surface through another layer of conductive path.

According to the present invention, all the coaxial wires are soldered on one surface of the PCB, and all the single wires are soldered on another surface of the PCB. It thus simplifies the process and saves the cost of producing the cable connector assembly.

DETAILED DESCRIPTION OF THE INVENTION

Figure 1:
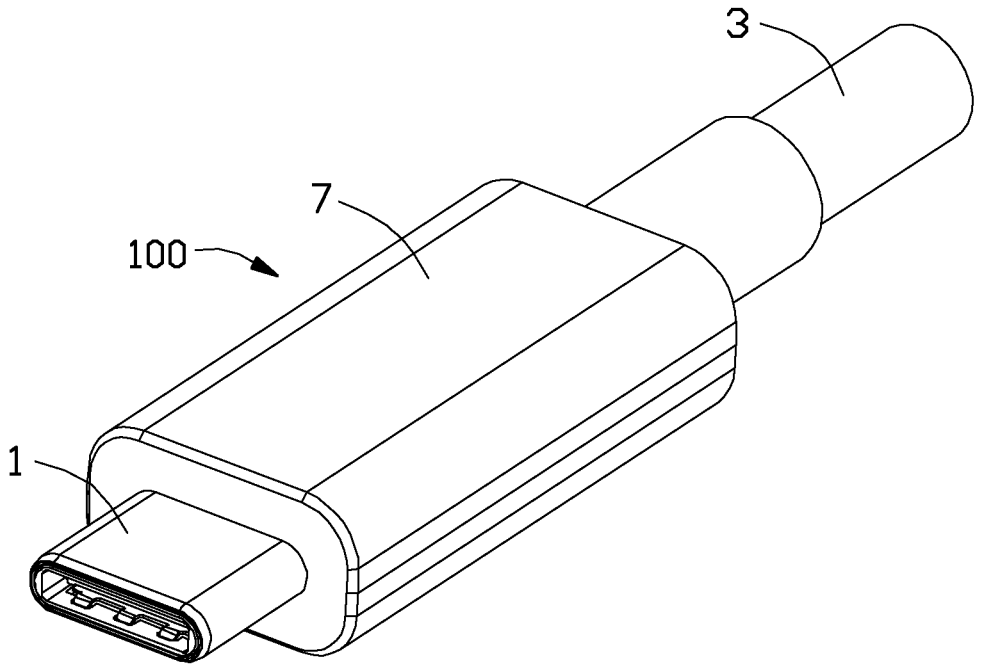
FIG. 1 is a perspective view of a cable connector assembly in accordance with the present invention.
Figure 2:
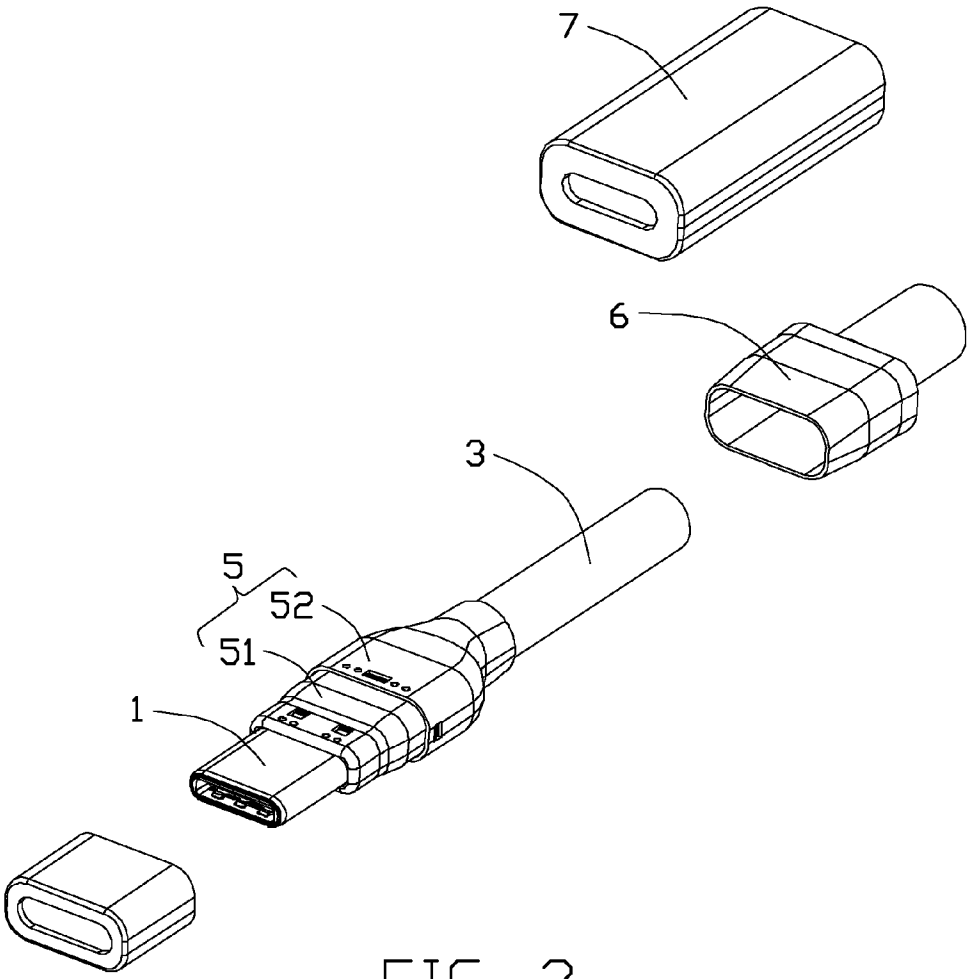
FIG. 2 is a partially exploded view of the cable connector assembly as shown in FIG. 1.

Referring to FIGS. 1 to 8, a cable connector assembly 100 in accordance with the present invention for mating with a mating connector (not shown) comprises a mating member 1, a printed circuit board (PCB) 2 connected to the mating member 1, a cable 3 electrically connected with the PCB 2, a spacer 4 limiting the cable 3, an inner member 5 enclosing part of the cable 3 and the mating member 1, a strain relief 6 molded out of the cable 3 and the inner member 5, and a housing 7 disposed outside. The cable connector assembly 100 can be mated with the mating connector in two different directions to achieve the same function.

Figure 9:
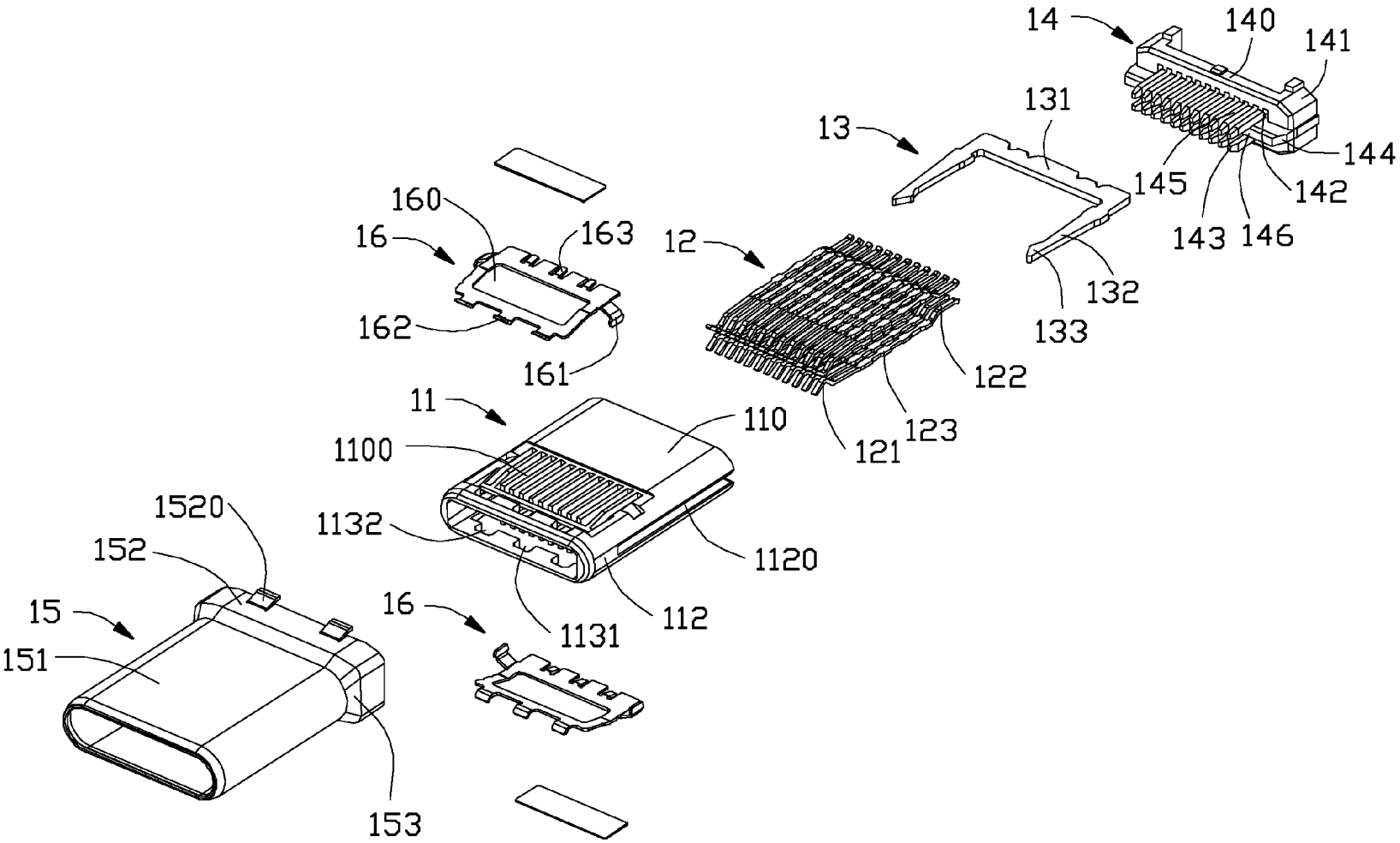
FIG. 9 is an exploded view of the mating member of the cable connector assembly as shown in FIG. 1.
Figure 10:
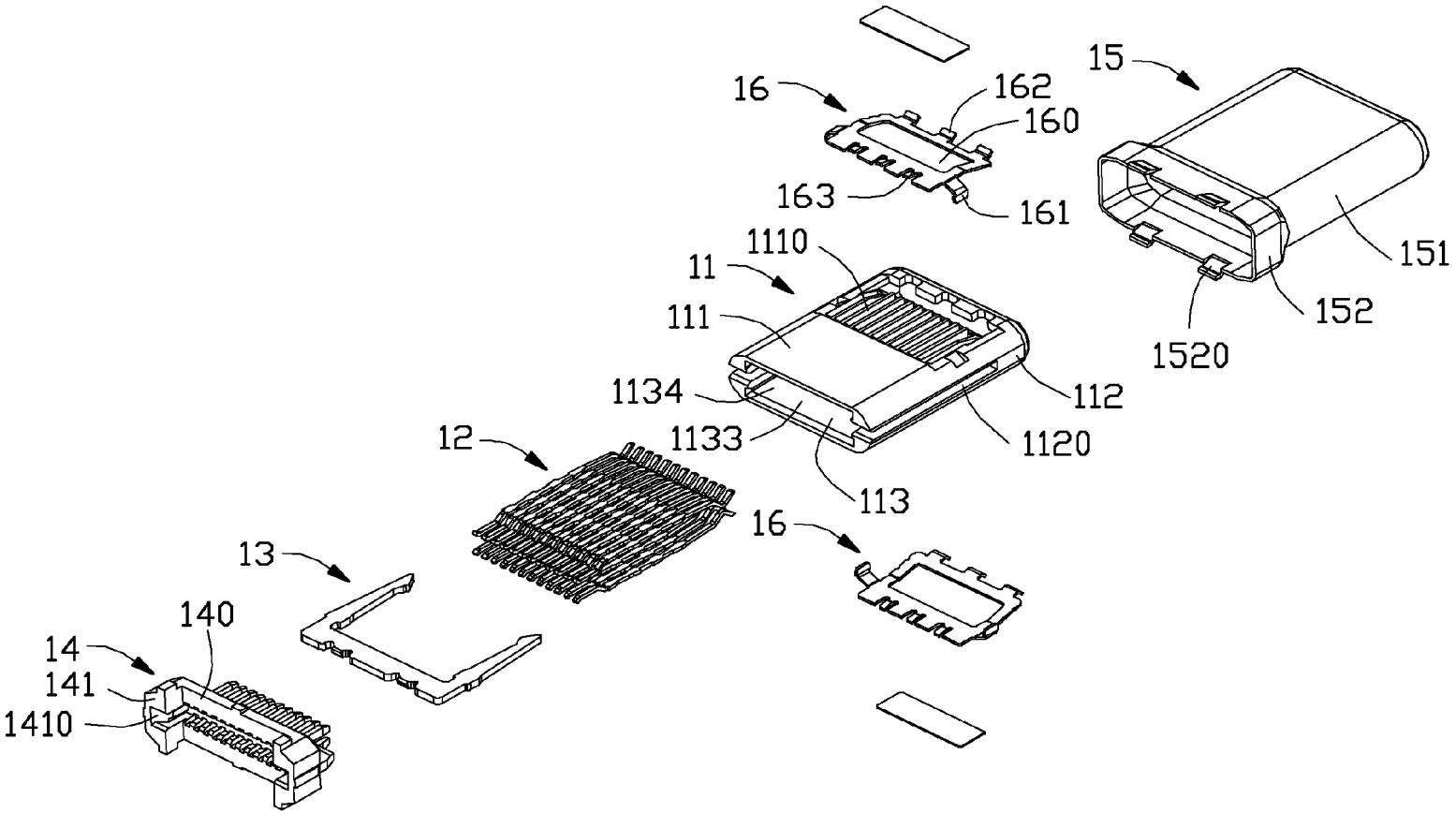
FIG. 10 is exploded view of the mating member of the cable connector assembly as shown in FIG. 9 but from a different perspective.

Referring to FIGS. 9 and 10, the mating member 1 comprises an insulative housing 11, a plurality of conductive terminals or contacts 12 received in the insulative housing 11 and arranged in two rows spaced apart from each other in a vertical direction, a latch 13 disposed between the two rows of conductive terminals 12 for latching with the mating connector, an insulative member 14 disposed behind the insulative housing 11, a metal shell 15 disposed outside of the insulative housing 11 and the insulative member 14, and a pair of grounding members 16 disposed on the insulative housing 11 and electrically connected to the metal shell 15. As well known, this embodiment refers to USB Type C connector wherein each row of terminals 12 includes power contacts, grounding contacts, at least one signal contact and differential-pair contacts.

The insulative housing 11 comprises a top wall 110, a bottom wall 111 spaced apart from and parallel with the top wall 110, a pair of side walls 112 connecting the top wall 110 and the bottom wall 111, and a receiving room 113 surround by the top, bottom, and side walls. The receiving room 113 is divided into a front portion 1132 having a front opening 1131, and a rear portion 1134 having a rear opening 1133. The top wall 110 defines a top recess 1100 in communication with the front portion 1132. The bottom wall 111 defines a bottom recess 1110 in communication with the front portion 1132. Each of the side walls 112 defines a side recess 1120 extending forwardly from a rear end of the insulative housing 11 but not through a front end of the insulative housing 11. The side recesses 1120 are in communication with the front portion 1132 and the rear portion 1134 of the receiving room 113.

Each of the contacts 12 comprises a front mating portion 121 extending forwardly into the front portion 1132 of the receiving room 113, a rear mating portion 122 extending rearwardly, and an intermediate mounting portion 123 secured to the insulative housing 11. The front mating portion 121 is to be mated with the mating connector and the rear mating portion 122 is to be mated with the PCB 2. The front mating portions 121 of the two rows of contacts 12 are arranged face to face along the vertical direction. In this embodiment, the arrangement of an upper row contacts along a left to right direction is GND, RX2+, RX2−, $V_{BUS}$, RFU1, D−, D+, CC1, $V_{BUS}$, TX1−, TX1+, GND. The arrangement of a lower row contacts along a left to right direction is GND, TX2−, TX2+, $V_{BUS}$, CC2, RFU2, $V_{BUS}$, RX1−, RX1+, GND. The lower row contacts is central symmetric to the upper row contacts except two empty position respect to the D− and D+.

The latch 13 comprises a base portion 131 extending along a transverse direction, a pair of latch beams 132 respectively extending forwardly from two opposite ends of the base portion 131, a latch portion 133 extending from a front end of each latch beam 132 along a face to face direction. The latch 13 is mounted into the insulative housing 11 through the rear opening 1133 of the rear portion 1134 of the receiving room 113. The latch beams 132 are received into the side recesses 1120, respectively. At least a portion of each of the latch portions 133 projects into the front portion 1132 of the receiving room 113. The pair of latch portions are arranged face to face along the transverse direction.

The insulative member 14 cooperates with the insulative housing 11 to fix the latch 13. The insulative member 14 comprises an insulative base portion 140, a pair of extending portions 141 extending rearwardly from two opposite ends of the insulative base portion 140, two rows of through holes 142 spaced apart in the vertical direction and extending through the insulative base portion 140 along a front to rear direction, two rows of posts 143 spaced apart in the vertical direction and extending forwardly, and a projected portion 144 extending forwardly between the two rows of posts 143. A channel 145 is formed between every two adjacent posts 143 of each row and is in communication with a corresponding one of the through holes 142. Each of the extending portions 141 defines a mounting slot 1410 extending along a rear to front direction. The posts 143 extend forwardly beyond the projected portion 144. A receiving slot 146 is formed between the two rows of posts 143. The insulative base portion 140 is thicker than the insulative housing 11. The insulative base portion 140 extends outwardly respect to the top wall 110 and the bottom wall 111 after the insulative member 14 being mounted to the insulative housing 11 along a rear to front direction. The base portion 131 of the latch 13 is received into the receiving slot 146 of the insulative member 14, and the projected portion 144 is pressed against a rear side of the base portion 131. The rear mating portions 122 of the contacts 12 extend through the insulative member 140 by passing the channels 145 and the through holes 142, respectively.

The metal shell 15 has a closed circumference that has a good seal performance, a good anti-EMI performance, etc. The closed circumference of the metal shell 15 could be manufactured by drawing a metal piece, bending a metal piece, die casting, etc. The metal shell 15 comprises a first front end 151 for being inserted into the mating connector, a first rear end 152, and a first transition portion 153 for connecting the first front end 151 and the first rear end 152. A diametrical dimension of the first front end 151 is smaller than the diametrical dimension of the first rear end 152. The first rear end 152 comprises a pair of latch tabs 1520 projecting outwardly.

One of the grounding members 16 is received on the top recess 1110, and the other one is received on the bottom recess 1110. Each of the grounding members 16 comprises a flat body portion 160, a pair of mounting portions 161 extending from two opposite ends of the flat body portion 160 and toward the insulative housing 11 for being attached to the insulative housing 11, a plurality of front grounding tabs 162 extending forwardly from a front side of the flat body portion 160 and entering into the front portion 1132 of the receiving room 113, and a plurality of rear grounding tabs 163 extending rearwardly from a rear side of the flat body portion 160. The front grounding tabs 162 are used for mating with the mating connector. The rear grounding tabs 163 are used for mating with the metal shell 15. The front grounding tabs 162 of the pair grounding members 16 are disposed face to face along the vertical direction. A distance along the vertical direction between the front grounding tabs 162 of the pair of grounding members 16 is greater than a distance along the vertical direction of the front mating portions 121 of the two rows of contacts 12.

Figure 7:
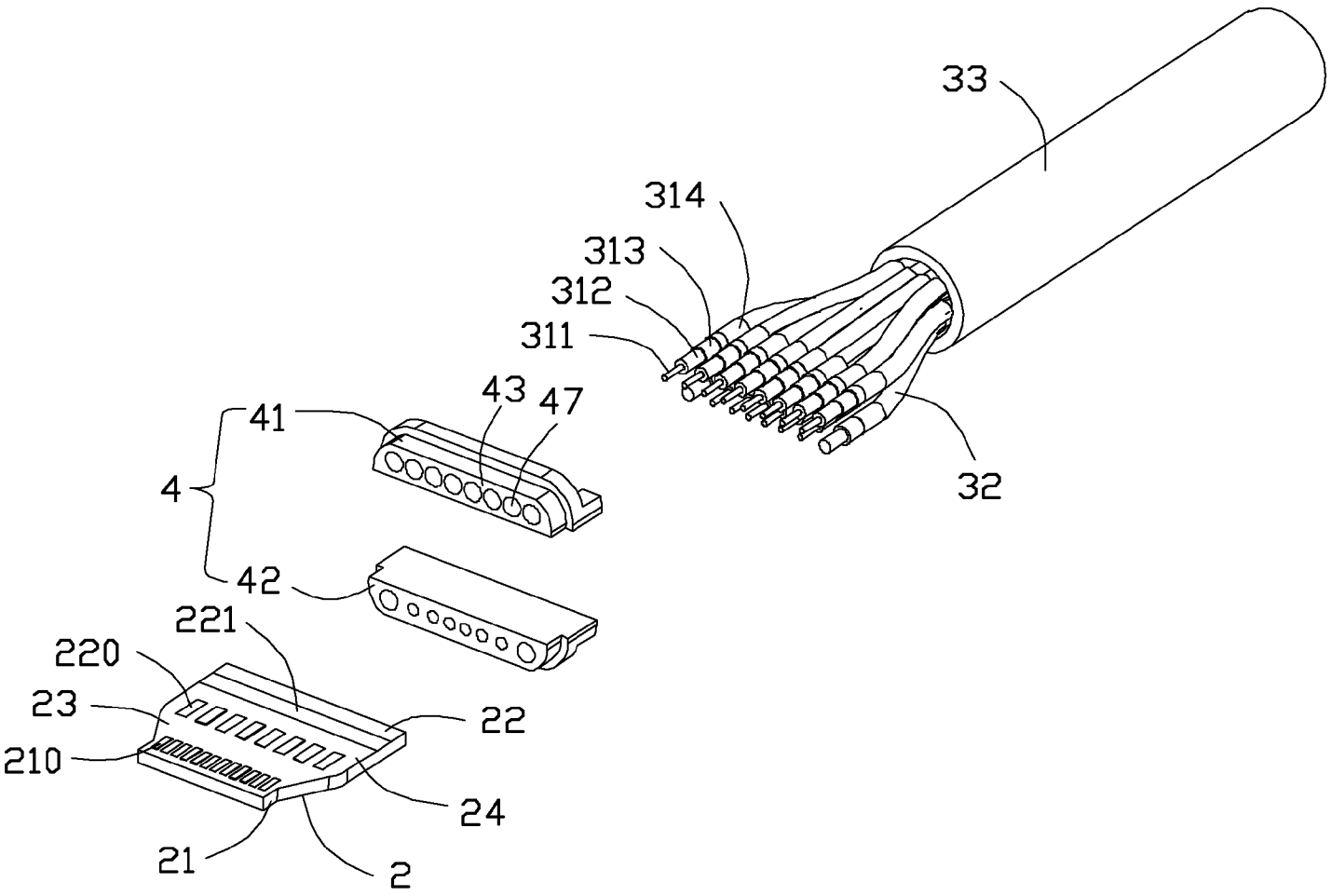
FIG. 7 is an exploded view of partly members of the cable connector assembly as shown in FIG. 5.
Figure 8:
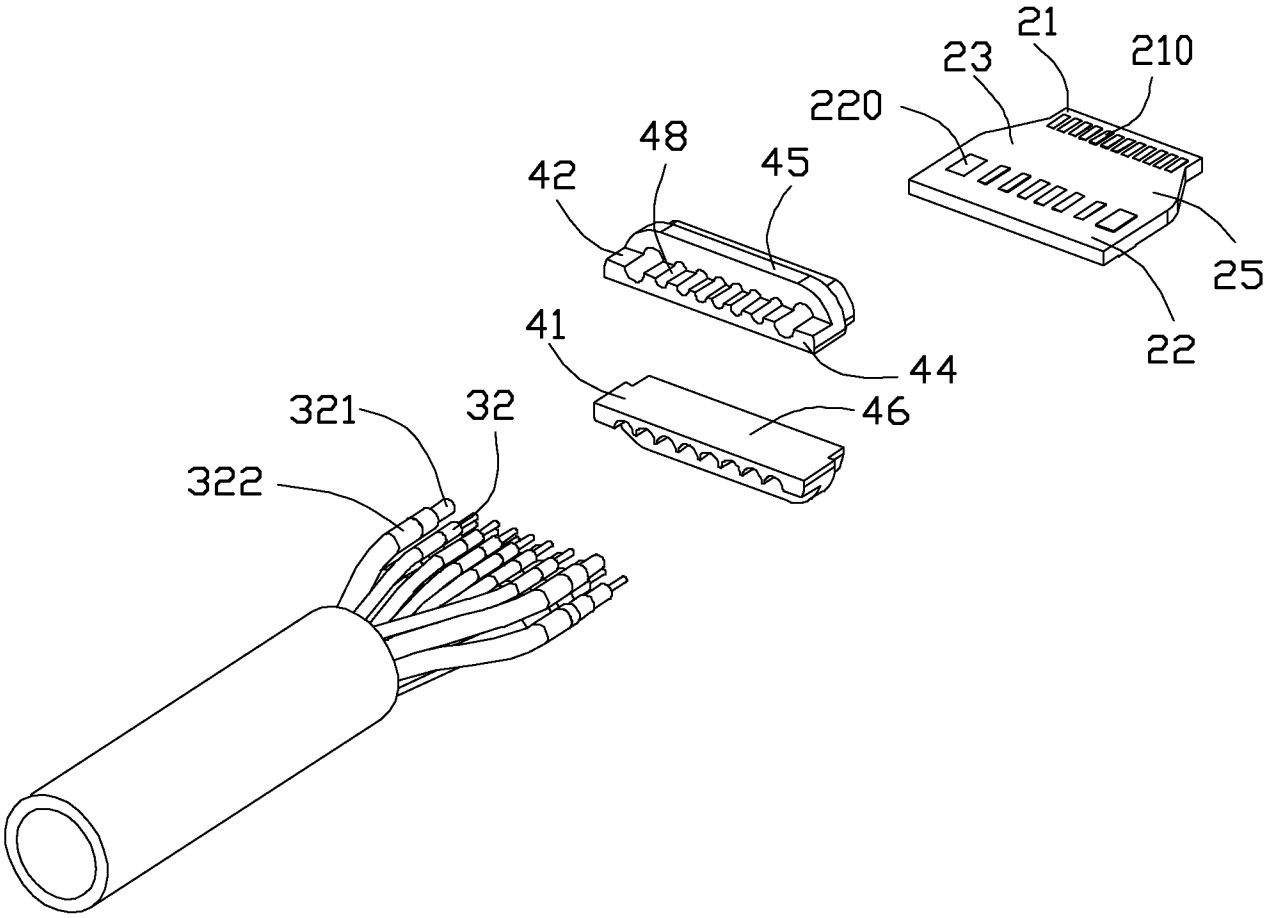
FIG. 8 is exploded view of partly members of the cable connector assembly as shown in FIG. 7 but from a different perspective.

Referring to FIGS. 7 and 8, the PCB 2 is disposed between the mating member 1 and the cable 3. The cable 3 is electrically connected with the contacts 12 by the PCB 2. The PCB 2 comprises a front end portion 21, a rear end portion 22, and a middle portion 23 connecting the front end portion 21 and the rear end portion 22. The PCB 2 comprises an upper surface 24 and an opposite lower surface 25. The upper and the lower surface of the front end portion 21 comprise a plurality of front conductive pads 210 connected with the rear mating portion 122 of the contacts 12, while the upper and the lower surface of the rear end portion 22 comprise a plurality of rear conductive pads 220 connected to the cable 3. A metal or grounding bar 221 is disposed behind the rear conductive pads 220 on the upper surface 24. Part of the rear conductive pads 220 are electrically connected to the corresponding front conductive pads 210 on the upper surface 24 through a layer of conductive path, while the other rear conductive pads 220 are electrically connected to the corresponding front conductive pads 210 on the lower surface 25 through another layer of conductive path. Duo to the rear conductive pads 220 need be connected to the front conductive pads 210 on the upper and low surfaces, respectively, so an inner portion of the PCB 2 should be designed by through-hole.

The arrangement of the front conductive pads 210 on the upper surface 24 and the lower surface 25 are corresponding to the arrangement of the upper row contacts and the lower row contacts. The arrangement of the rear conductive pads 220 on the upper surface 24 is TX1+, TX1−, TX2+, TX2−, RX1+, RX1−, RX2+, RX2−. The arrangement of the rear conductive pads 220 on the lower surface 25 is $V_{BUS}$, RFU1, D+, D−, CC2, CC1, RFU2, GND. Specifically, TX1+, TX1−, TX2+, TX2−, RX1+, RX1−, RX2+, RX2− are the high speed signal pairs. $V_{BUS}$ is used for transmitting power signal. RFU1 and RFU2 are spare function. D+ and D− are used for transmitting the signal of USB 2.0. CC1 and CC2 are used for transmitting control signal. GND are used for transmitting grounding signal.

A size of the front end portion 21 of the PCB 2 is smaller than the size of the rear end portion 22 along a transverse direction. A pitch between the adjacent front conductive pads 210 is smaller than the pitch between the adjacent rear conductive pads 220. The size of the rear conductive pad 220 is larger than the size of the front conductive pad 210, and the number of the front conductive pad 210 larger than the number of the rear conductive pads 220. The front portion 21 of the PCB 2 is mounted between the rear mating portions 122 of the two rows of contacts 12. The rear mating portions 122 of the contacts 12 are electrically connected with the corresponding front conductive pads 210.

The cable 3 has a sheath 33 that contains a plurality of coaxial wires 31 and a plurality of single wires 32. The coaxial wires 31 should be handled by cutting for more times than the single wires 32. All the coaxial wires 31 are soldered on the upper surface 24, and all the single wires 32 are soldered on the lower surface 25 of the PCB 2. All the coaxial wires 31 also can be soldered on the lower surface 25 together with the metal bar 221 in the other embodiments. A front end of each coaxial wire 31 is arranged in a line in a horizontal direction, and the front end of each single wire 32 is arranged in a line in a horizontal direction too, so that the wires can be convenient to be processed at same time. It is convenient to cut and soldered the coaxial wires 31 on the upper surface at same time. And the single wires 32 can be cut and soldered on the lower surface at same time too. Each coaxial wire 31 comprises a first inner conductor 311, an inner insulative layer 312 enclosing the first inner conductor 311, a metal braided layer 313 enclosing the inner insulative layer 312, and an outer insulative layer 314 enclosing the metal braided layer 313. Each metal braided layer 313 of the coaxial wires 31 is soldered with the metal bar 221. Each single wire 32 comprises a second conductor 321 and an outer jacket 322 enclosing the second conductor 321. In this embodiment, there are eight single wires 32 and eight coaxial wires 31. In the other embodiments, the number can be changed according to necessity.

In this embodiment, the spacer 4 comprises an upper half 41 limiting the coaxial wires 31 on the upper surface 24 and a lower half 42 mounted to the upper half 41 for limiting the single wires 32 on the lower surface 25. The spacer 4 also can be disposed in one piece in other embodiments. Each upper half 41 and lower half 42 comprises a front wall 43 proximal to the PCB 2, an opposite rear wall 44, and an upper wall 45 and a lower wall 46 connecting the front wall 43 and the rear wall 44. The spacer 4 comprises a plurality of positioning holes 47 passing through the front wall 43 and the rear wall 44 for locating the coaxial wires 31 and the single wires 32. A rear end of the spacer 4 comprises a plurality of limiting slots 48 for preventing the coaxial wires 31 and the single wires 32 from moving along a transverse direction.

Figure 3:
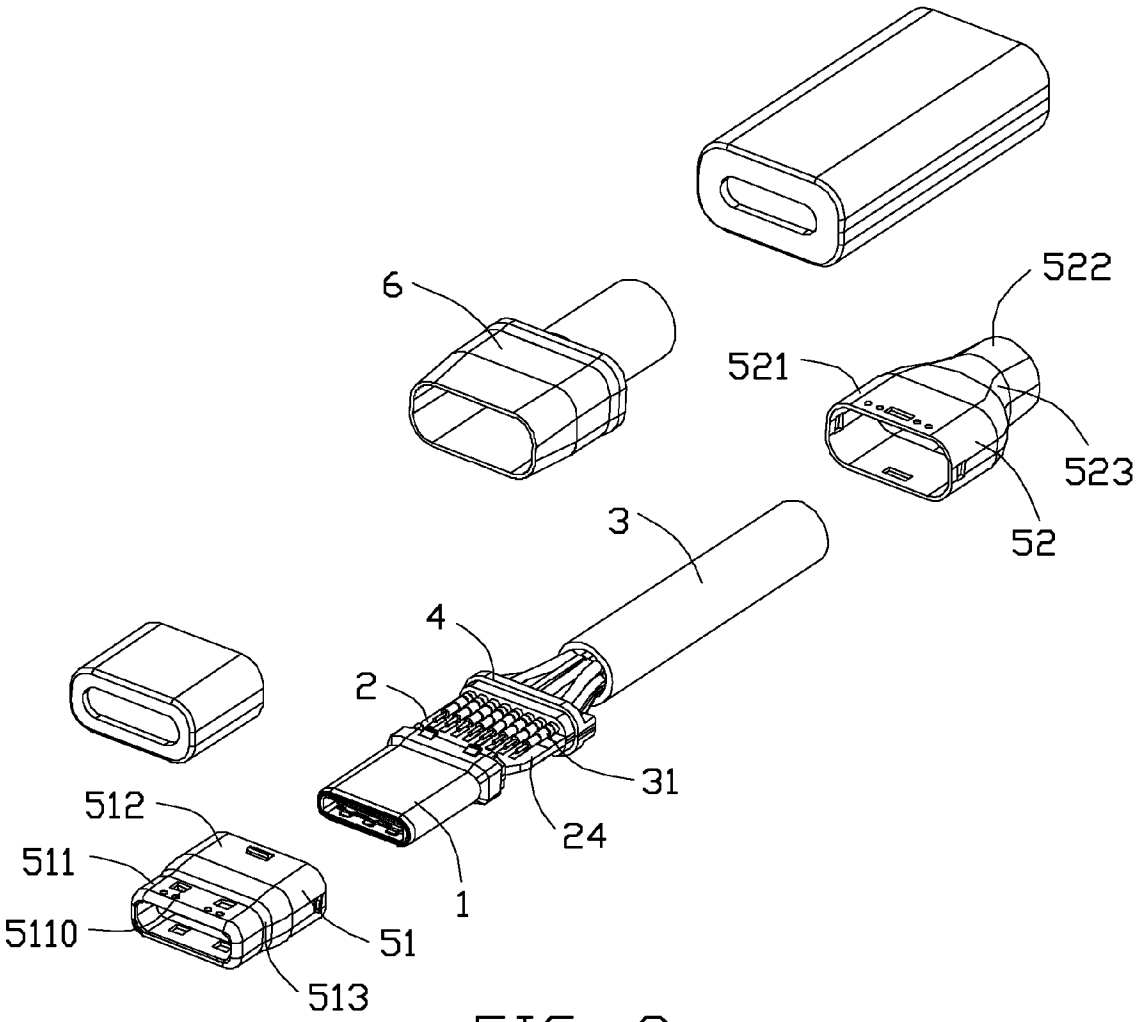
FIG. 3 is another partially exploded view of the cable connector assembly as shown in FIG. 1.
Figure 4:
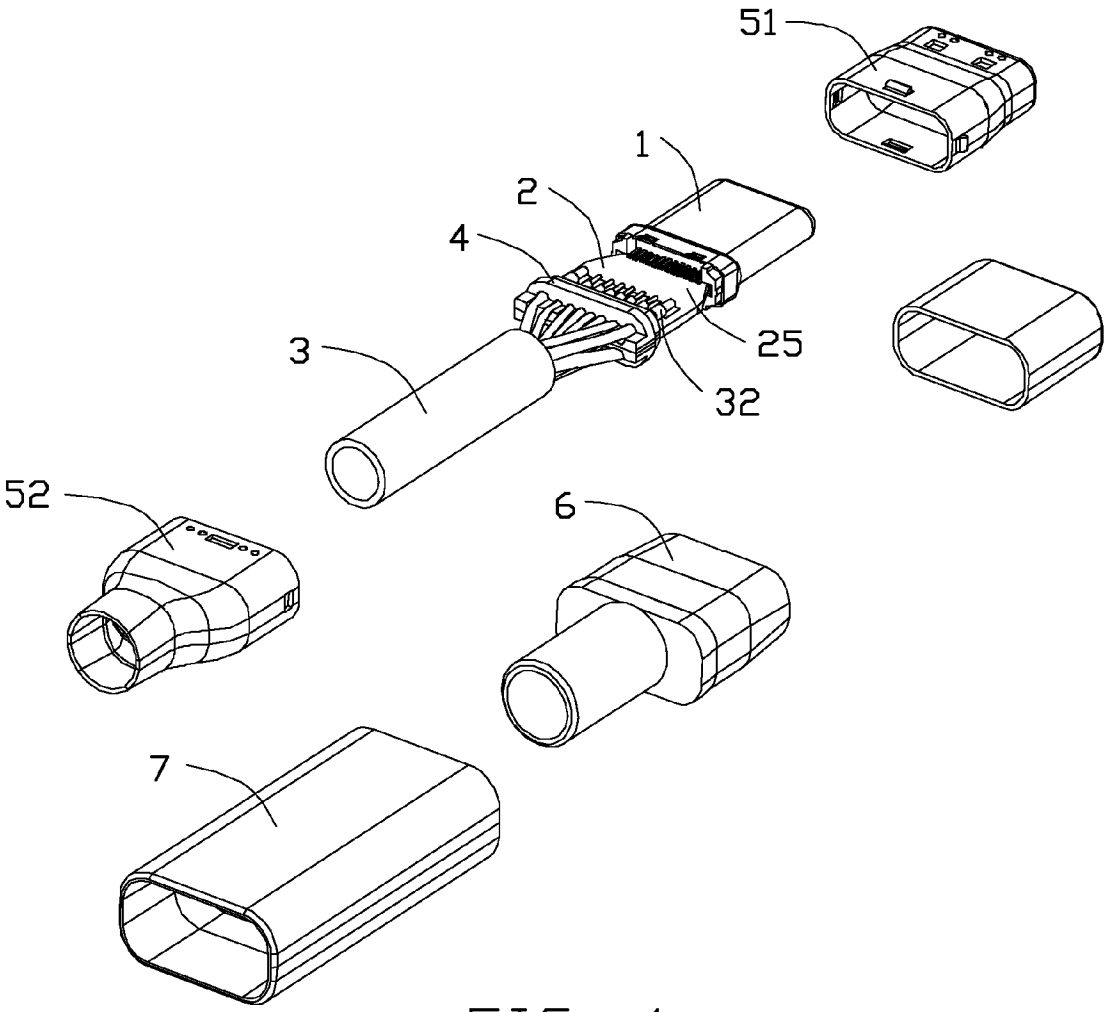
FIG. 4 is a partially exploded view of the cable connector assembly as shown in FIG. 3 but from a different perspective.
Figure 5:
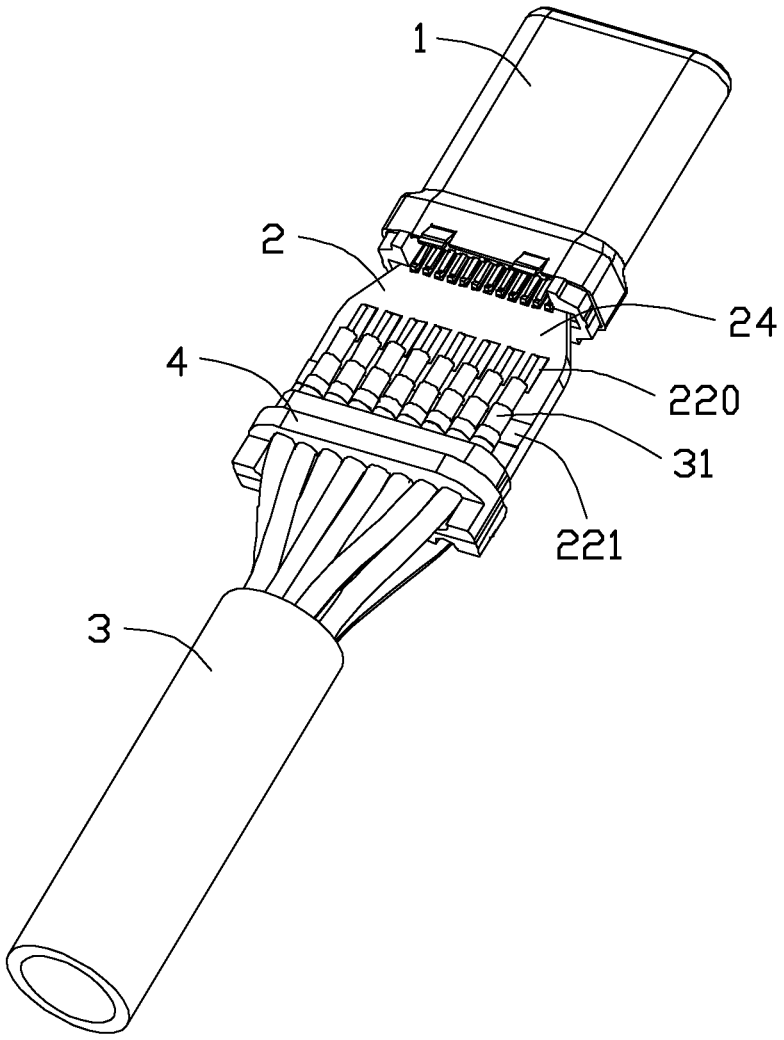
FIG. 5 is a perspective view of partly members of the cable connector assembly as shown in FIG. 1.
Figure 6:
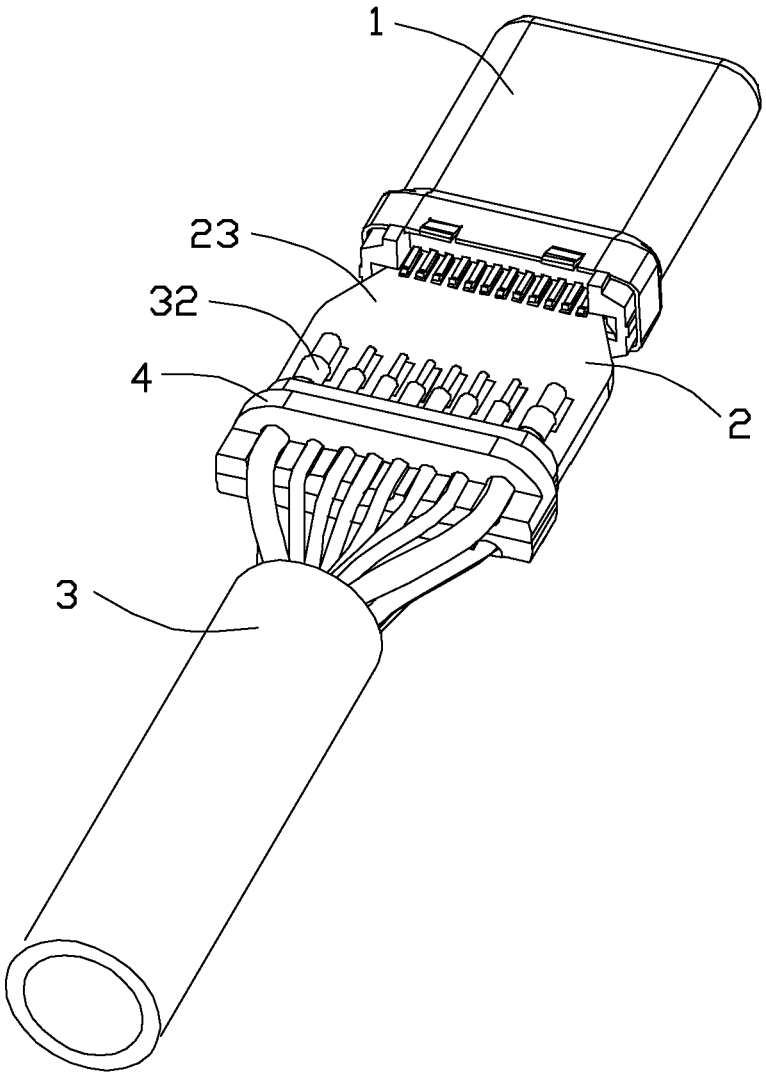
FIG. 6 is perspective view of partly members of the cable connector assembly as shown in FIG. 5 but from a different perspective.

Referring particularly to FIGS. 3 and 4, the inner member 5 comprises a first member 51 and a second member 52. The first member 51 has a closed circumference that has a good seal performance, a good anti-EMI performance, etc. The closed circumference of the first member 51 could be manufactured by drawing a metal piece, bending and forming a metal piece, die casting, etc. The first member 51 comprises a second front end 511 telescoped with a rear end of the mating member 1, a second rear end 512 opposite to the second front end 511, and a second transition portion 513 between the second front and rear ends. The diametrical dimension of the second front end 511 is larger than the diametrical dimension of the second rear end 512. The second front end 511 defines a pair of latch holes 5110 latched with the latch tabs 1520 of the metal shell 15, when the second member 51 is telescoped on an outer side of the first rear end 152 of the metal shell 15. The second front end 511 of the first member 51 is interference fit with the first rear end 152 of the metal shell 15. The second front end 511 of first member 51 and the first rear end 152 of the metal shell 15 are further connected by laser welding in some spots or full circumference to have a good strength. The second rear end 512 is telescoped on an outer side of the spacer 4.

The second member 52 has a closed circumference that has a good seal performance, a good anti-EMI performance, etc. The closed circumference of the second member 52 could be manufactured by drawing a metal piece, bending and forming a metal piece, die casting, etc. The second member 52 comprises a main portion 521 telescoped with the second rear end 512 of the first member 51, a ring portion 522 telescoped and crimped with the cable 3, and a third transition portion 523 between the main portion 521 and the ring portion 522. The diametrical dimension of the main portion 521 is larger than the diametrical dimension of the ring portion 522. In assembling, firstly, the second member 52 is telescoped on the cable 3. The second member 52 is moved forwardly and telescoped on the spacer 4, after the wires 31 and 32 are soldered on the rear conductive pads 220. Then, the second member 52 is forwardly moved beyond the spacer 4 to latch with the first member 51. The main portion 521 of second member 52 and the second rear end 512 of the first member 51 are further connected by spot laser welding to have a good strength.

The strain relief 6 is molded on the second member 52 and the cable 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a cable;

an internal printed circuit board (PCB) comprising a front end portion, an opposite rear end portion, and a middle portion, the front end portion comprising a plurality of front conductive pads, the rear end portion comprising a plurality of rear conductive pads connected to the cable, the PCB having an upper surface and an opposite lower surface; and a housing receiving the PCB; wherein the cable comprises a plurality of coaxial wires and a plurality of single wires, the coaxial wires soldered on one surface of the PCB and the single wires soldered on another surface of the PCB;

some of the rear conductive pads soldered with the coaxial wires are electrically connected to corresponding front conductive pads on the PCB upper surface through a first set of conductive paths, while the other rear conductive pads soldered with the coaxial wires are electrically connected to corresponding front conductive pads on the lower surface through a second set of conductive paths; and the PCB comprises a metal bar behind the rear conductive pads soldered with the coaxial wires, each coaxial wire comprising a first inner conductor, an inner insulative layer enclosing the first inner conductor, a metal braided layer enclosing the inner insulative layer, and an outer insulative layer enclosing the metal braided layer, each metal braided layer of the coaxial wires soldered with the metal bar.

2. The cable connector assembly as recited in claim 1, wherein front ends of each coaxial wires are arranged in a horizontal line, or front ends of each single wires are arranged in another horizontal line.

3. The cable connector assembly as recited in claim 1, wherein a size of the PCB front end portion is smaller than a size of the PCB rear end portion, and a pitch between adjacent front conductive pads is smaller than a pitch between adjacent rear conductive pads.

4. The cable connector assembly as recited in claim 1, wherein a size of the rear conductive pad is larger than a size of the front conductive pad.

5. The cable connector assembly as recited in claim 1, further comprising a spacer accommodating the cable, the spacer comprising a front wall proximal to the PCB and an opposite rear wall distal from the PCB, the spacer comprising a plurality of positioning holes extending through the front wall and the rear wall for positioning the coaxial wires in one row and the single wires in another row.

6. The cable connector assembly as recited in claim 1, wherein some of the rear conductive pads soldered with the single wires are electrically connected to corresponding front conductive pads on the PCB upper surface through a third set of conductive paths, while the other rear conductive pads soldered with the single wires are electrically connected to corresponding front conductive pads on the lower surface through a fourth set of conductive paths.

7. The cable connector assembly as recited in claim 1, wherein the first set of conductive paths extend in a first layer, and the second set of conductive paths extend in a second layer.

8. A cable connector assembly comprising:

an insulative housing defining a mating port forwardly communicating with an exterior along a front-to-back direction;

opposite first and second rows of terminals disposed in the housing in a vertical direction perpendicular to said front-to-back direction, each row of said first and second rows extending along a lengthwise direction perpendicular to both said front-to-back direction and said vertical direction, each of said terminals defining a front contacting section exposed in the mating port and a rear connecting section exposed outside of the housing, each of said first and second rows of terminals being categorized with at least power contacts, grounding contacts, a signal contact and differential-pair contacts, so as to have the first row of terminals and the second row of terminal arranged to be diagonally symmetric with each other for allowing the cable connector assembly to be used in a flappable manner disregarding orientations in the vertical direction;

a printed circuit board located behind the housing in the front-to-back direction and having two opposite first and second surfaces in the vertical direction, opposite front row and rear row of conductive pads formed on each of said first and second surfaces;

a cable including a plurality of single signal wires, a plurality of differential-pair wires, at least a single power wire and at least a single grounding wire electrically corresponding to said signal contacts, said differential-pair contacts, said power contacts and said grounding contacts; wherein the front row of conductive pads on the first surface and the front row of conductive pads on the second surface are diagonally symmetric with each other, the connecting sections of the first row of terminals are respectively soldered upon the front row of conductive pads on the first surface correspondingly, and the connecting sections of the second row of terminals are respectively soldered upon the front row of the conductive pads on the second surface correspondingly; wherein all the differential-pair wires are soldered upon the rear row of conductive pads on the first surface while the remaining single wires are soldered upon the rear row of conductive pads on the second surface; wherein the rear row of conductive pads located on both the first and second surfaces, and the front row of conductive pads located on both the first and second surfaces are mutually electrically connected with each other via conductive paths in the printed circuit board.

9. The cable connector assembly as claimed in claim 8, wherein the power wire and the grounding wire are diametrically larger than those of the signal wires, and the conductive pads corresponding to the power wire and the grounding wire are larger than those for the signal wires.

10. The cable connector assembly as claimed in claim 9, wherein the conductive pads for the power wire and the grounding wires are located by two opposite ends of those for the signal wires in the vertical direction.

11. The cable connector assembly as claimed in claim 8, wherein an amount of the front row of conductive pads is more than that of the rear row of conductive pads.

12. The cable connector assembly as claimed in claim 11, wherein the front row of conductive pads on both said first and second surfaces for power are electrically joined as one conductive pad for power in the rear row, and the front row of conductive pads on both said first and second surfaces for grounding are electrically joined as one conductive pad for grounding in the rear row.

13. The cable connector assembly as claimed in claim 8, wherein a grounding bar extends in the transverse direction upon the first surface of the printed circuit board behind the rear row of conductive pads.

* * * * *